US007861330B2

(12) United States Patent
Tau et al.

(10) Patent No.: US 7,861,330 B2
(45) Date of Patent: Jan. 4, 2011

(54) UNIVERSAL TOILET TANK LEVER

(75) Inventors: Michael Scott Tau, Charlotte, NC (US); Iosif Manga, Irvine, CA (US); Billy Ray Smith, Jr., Monroe, NC (US)

(73) Assignee: Brasstech, Inc., Santa Ana, CA (US)

( * ) Notice: Subject to any disclaimer, the term of this patent is extended or adjusted under 35 U.S.C. 154(b) by 1131 days.

(21) Appl. No.: 11/405,335

(22) Filed: Apr. 17, 2006

(65) Prior Publication Data

US 2007/0240256 A1 Oct. 18, 2007

(51) Int. Cl.
*E03D 5/00* (2006.01)

(52) U.S. Cl. ..... 4/405; 4/411; 4/412; 4/249

(58) Field of Classification Search ..... 4/405, 4/411, 412, 413, 414, 249
See application file for complete search history.

(56) References Cited

U.S. PATENT DOCUMENTS 1,710,827 A * 4/1929 Johnson ..... 4/405
3,059,948 A * 10/1962 Thompson et al. ..... 403/90
3,516,095 A * 6/1970 Clifton et al. ..... 4/246.5
3,518,703 A * 7/1970 Sherwood et al. ..... 4/412
6,092,245 A * 7/2000 Jones ..... 4/412
7,434,275 B1 * 10/2008 DeVore et al. ..... 4/405
2005/0273919 A1 12/2005 Berlovan

* cited by examiner

*Primary Examiner*—Gregory L Huson
*Assistant Examiner*—Karen Younkins
(74) *Attorney, Agent, or Firm*—Carlson, Gaskey & Olds PC

(57) ABSTRACT

A toilet tank lever assembly may be mounted in various toilet tanks by selective positioning of a long lever arm relative a short lever arm. One such lever assembly includes a long lever arm which may be mounted at an infinite degree of adjustment relative a short lever arm as provided by a ball and socket interface between the lever arms. The ability to reverse the short lever arm essentially doubles the number of mounting possibilities. By selecting between a front insert and a side insert, a handle is readily positioned for either front or side tank mounting. Various handles may also be readily attached to the lever post to provide various aesthetic appearances.

18 Claims, 8 Drawing Sheets

UNIVERSAL TOILET TANK LEVER

BACKGROUND OF THE INVENTION

The present invention relates generally to a toilet tank lever mechanism, and more particularly to a universal toilet tank lever that may be configured for various mounting locations within toilets of varying design.

Toilet lever mechanisms open the flush valve of toilets allowing the water stored in the toilet tank to enter the bowl of the toilet and cause the toilet to flush. Conventional toilet lever mechanisms are mounted to either the front or the side of the toilet tank and include a rod that extends into the toilet tank. The rod is connected to the flush valve of the toilet by a chain or other connector. When the handle of the toilet tank lever mechanism is rotated, the rod extending within the toilet tank rises and pulls the flush valve of the toilet upward, thereby flushing the toilet.

Due to the multitude of configurations and mounting locations for the toilet flushing mechanisms, conventional toilet tank lever mechanisms are configured for a specific flushing mechanism. Furthermore, different mechanisms are typically required depending upon whether the toilet lever mechanism is mounted toward the front or toward the side of the tank.

Accordingly, it is desirable to provide a universal tank lever assembly which is readily adjustable for use within a multitude of various toilet tanks.

SUMMARY OF THE INVENTION

The toilet tank lever assembly according to the present invention generally includes a tank lever handle, lever post, front insert or side insert, tank lever rosette, tank lever escutcheon, tank lever mounting gasket, mounting washer, mounting nut, short lever arm, belleville spring, fastener screw, lever fastener screw, and a long lever arm. The toilet tank lever assembly rotates about an axis of rotation as operated by rotation of the lever handle.

The long lever arm is mountable at various angles relative to the short lever arm such that various toilet tanks may be thereby accommodated. Reversing the short lever arm essentially doubles the number of mounting possibilities. Notably, because the belleville spring and fastener screw are located along the axis, the short lever arm may be readily reversed while still providing access to the fastener screw when the toilet tank lever assembly is mounted within the tank.

The tank lever escutcheon is of a common design such that various tank lever rosettes may be supported thereby. That is, the tank lever escutcheon is a structural component which may be utilized to support a multitude of various aesthetic tank lever rosettes to provide various aesthetic appearances.

By selecting between the front insert and the side insert, a handle is readily positioned for either front or side of the tank. Various handles may also be readily attached to the lever post to provide various aesthetic appearances. The engagement surface corresponds to what is a common faucet handle attachment such that the toilet tank handle may be matched to a faucet assembly within a bathroom.

Another toilet tank lever assembly includes a short lever arm that includes a semi-spherical socket while the long lever arm includes a semi-spherical ball. A threaded nut is engageable with corresponding threads on the short lever arm adjacent the semi-spherical socket. The long lever arm may thereby be mounted at various angles relative to the short lever arm such that various toilet tanks may be thereby accommodated. Essentially, an infinite degree of adjustment is provided by the ball and socket interface within the conical adjustment envelope.

The present invention therefore provides a universal tank lever assembly which is readily adjustable for use within a multitude of various toilet tanks.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
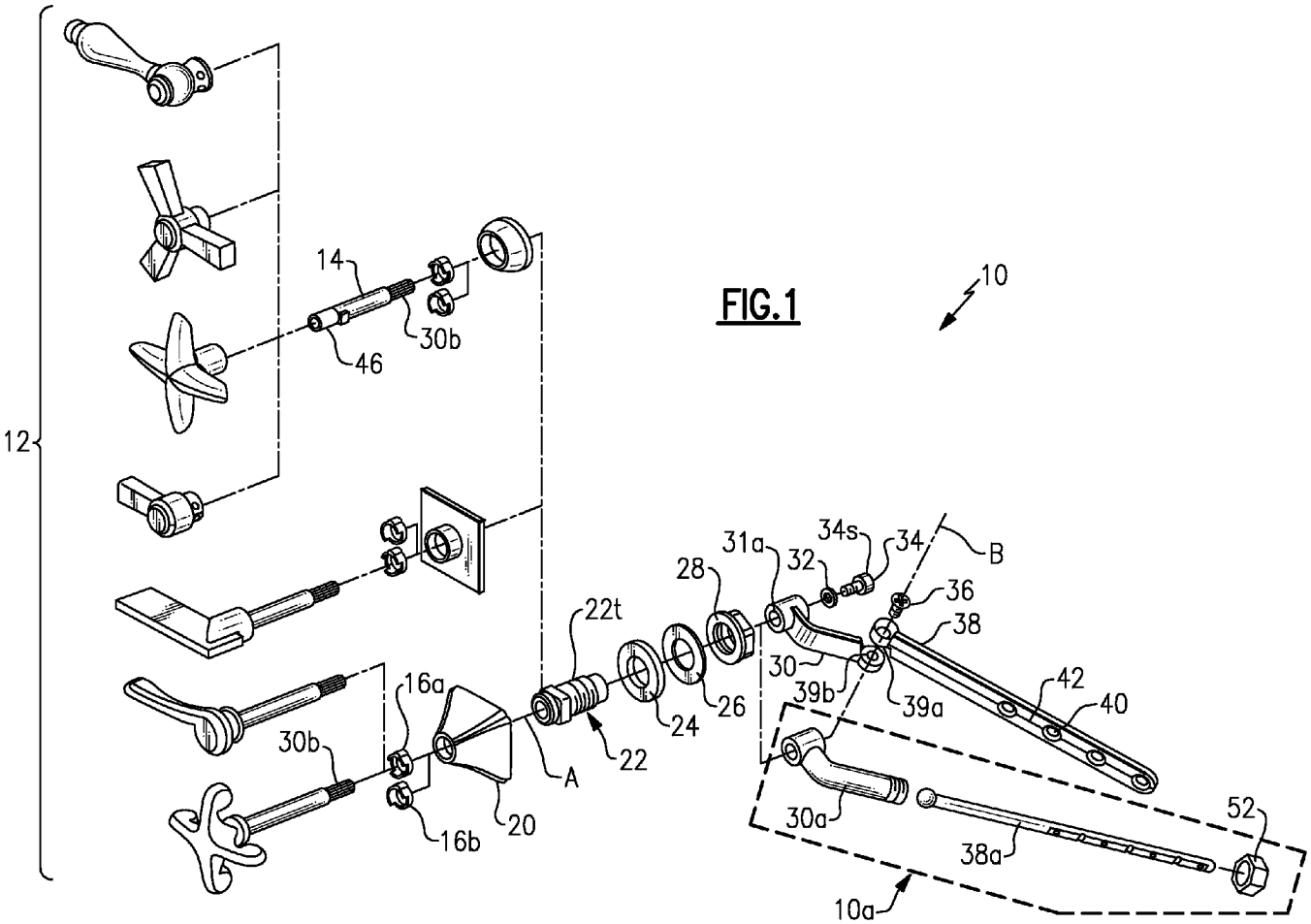
FIG. 1 is an exploded view of a toilet tank lever assembly.

FIG. 1 is an exploded view of a toilet tank lever assembly 10. The toilet tank lever assembly 10 provides the ability to mount the lever assembly 10 on any number of front or side mount toilet tanks with only a minor number of adjustments. From a manufacturing standpoint, this mechanism may be utilized on a multiple of designs rather than the more conventional "customized" bent rod design that may be utilized on only a single style of tank.

The toilet tank lever assembly 10 generally includes a tank lever handle 12, lever post 14, front insert 16*a* side insert 16*b*, tank lever rosette 20, tank lever escutcheon 22, tank lever mounting gasket 24, mounting washer 26, mounting nut 28, short lever arm 30, 30A, belleville spring 32, fastener screw 34, lever fastener screw 36, and a long lever arm 38 with a multiple of apertures 40. The toilet tank lever assembly 10 rotates about an axis of rotation A as operated by rotation of the lever handle 12.

The short lever arm 30 may be mounted at various azimuthal positions about the axis A relative the lever post 14 to still further increase the number of mounting possibilities. Preferably, a multiple tooth spline 31*a* within the short lever arm 30 engages a corresponding spline 30*b* on the lever post 14 such that the short lever arm 30 may be azimuthally positioned relative the lever post 14 about the axis A such that the flush mechanism may be arranged at a desired angle required to operate the flapper mechanism within tank. Preferably, approximately twenty splines permit adjustment in approximately 18 degree increments. By positioning the short lever arm 30 in one orientation on the lever post 14 the long lever arm 38 is positioned in a first orientation (FIG. 2A) while reversing the short lever arm 30 in a reverse direction on the lever post 14, the short lever arm 30 is arranged to position the long lever arm 38 in another orientation (FIG. 2B)

The long lever arm 38 is mountable at various angles relative to the short lever arm 30 such that various toilet tanks may be thereby accommodated (FIGS. 2A-2D). The long lever arm 38 and the short lever arm 30 each include a corresponding toothed interface 39*a*, 39*b* which permits the arms 38, 30 to radially lock together. The long lever arm 38 is readily positioned relative the short lever arm 30 about an axis B simply by loosening fastener 36, positioning long lever arm 38 then again securing fastener 36. The toothed interface 39*a*, 39*b* assure an effective non-slip interface.

The long lever arm 38 includes the multiple of apertures 40 to further facilitate attachment of the flapper mechanism chain within tank to provide still further adjustment. Preferably, the long lever arm 38 includes a multitude of cut-off grooves 42 such that a cut-off groove 42 is interspersed between each aperture 40 such that once a desired aperture is selected for attachment of the flapper mechanism chain, the portion of the lever arm 38 which extends past the selected aperture may simply be "snapped" or cut off.

Figure 2A:
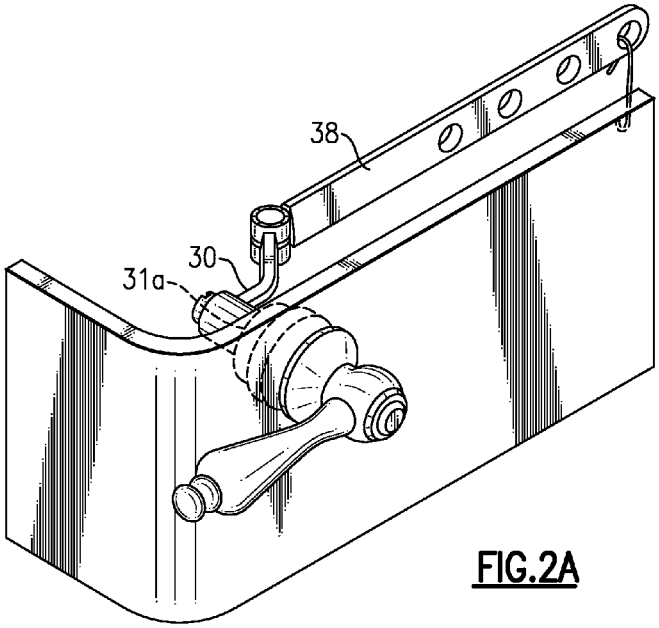
FIG. 2A is a toilet tank lever assembly mounted to the front of a toilet tank assembly.
Figure 2B:
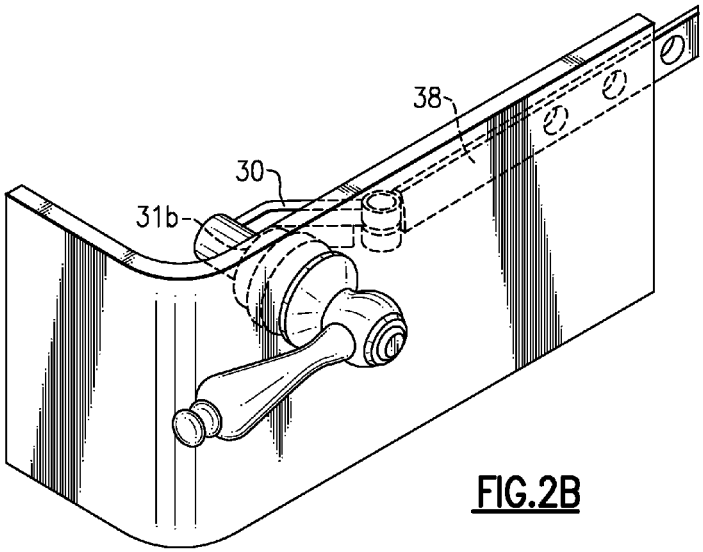
FIG. 2B is a toilet tank lever assembly mounted to the front of a toilet tank assembly with the short lever arm reversed.
Figure 2C:
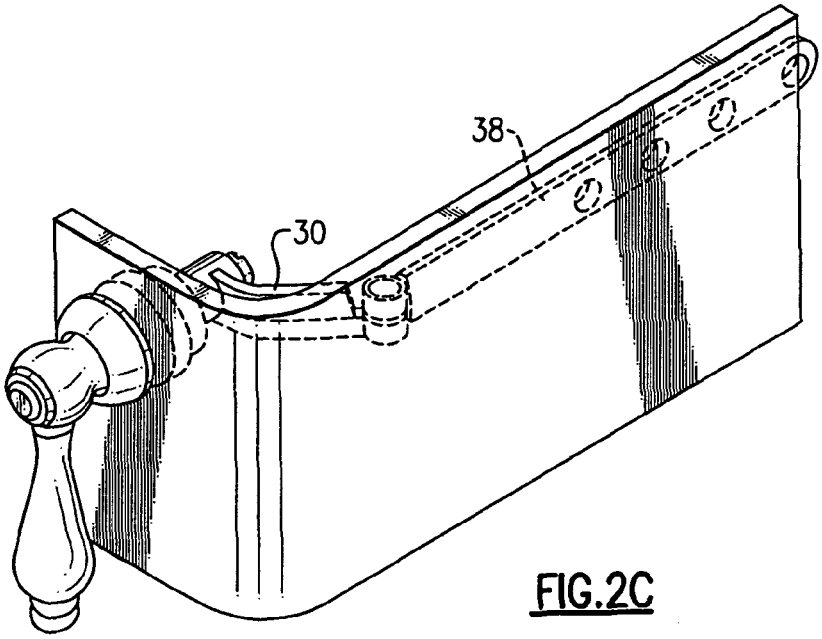
FIG. 2C is a toilet tank lever assembly mounted to the side of a toilet tank assembly.
Figure 2D:
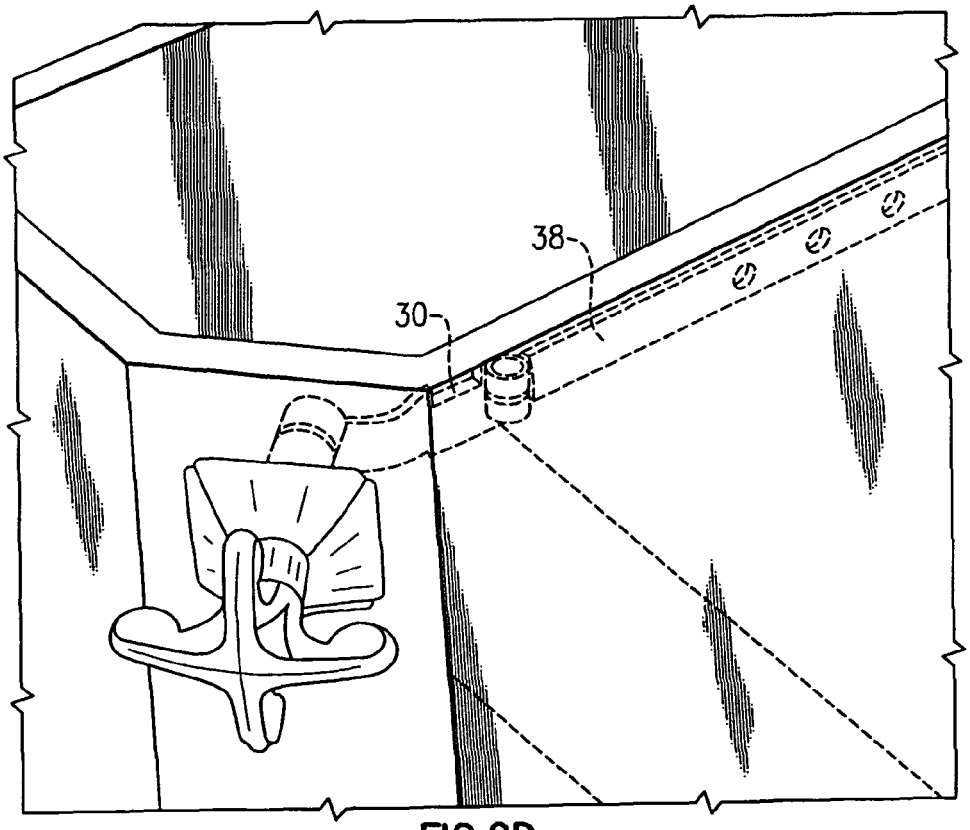
FIG. 2D is a toilet tank lever assembly mounted to the corner of a toilet tank assembly.
Figure 3A:
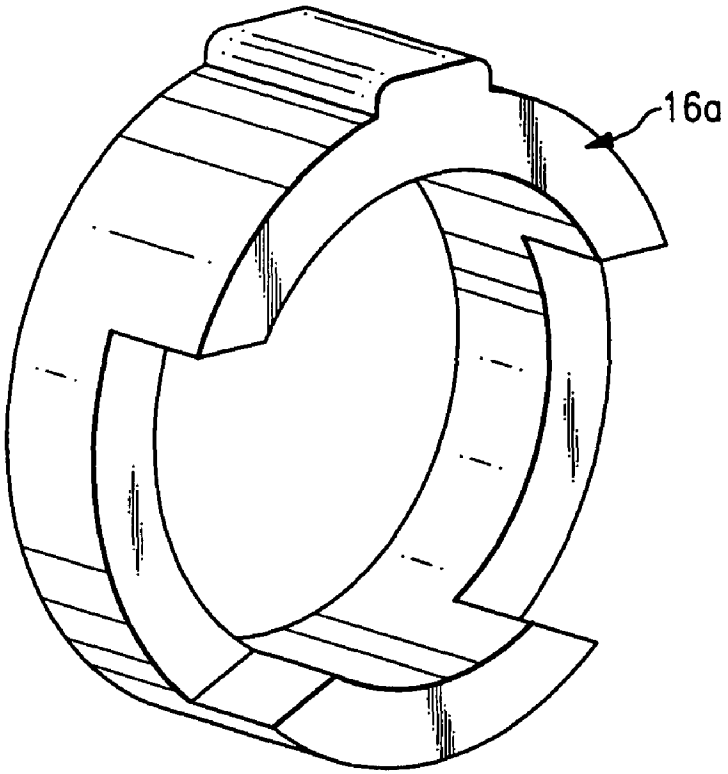
FIG. 3A is an expanded perspective view of an insert for front mounting of a handle assembly.
Figure 3B:
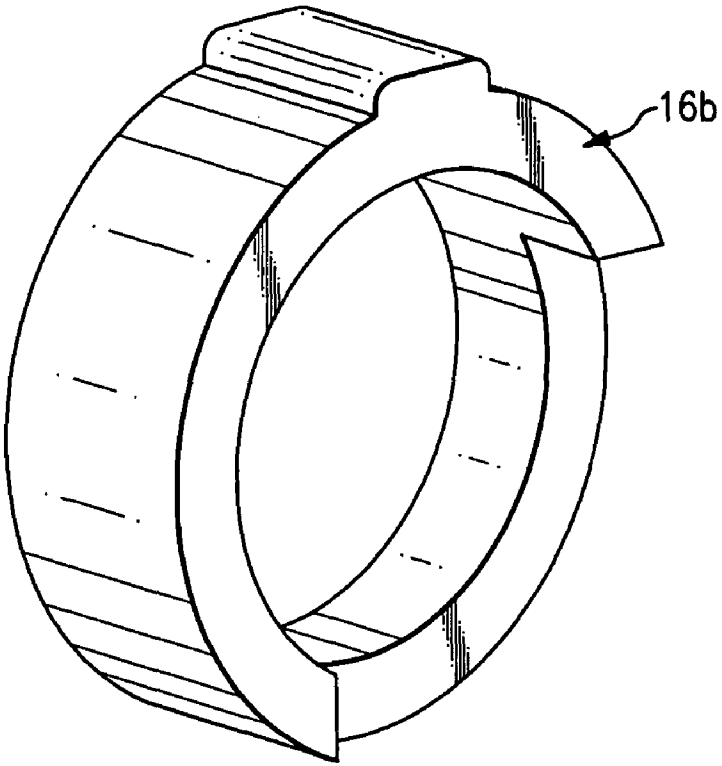
FIG. 3B is an expanded perspective view of a side insert for side mounting of a handle assembly.

By selecting between the front insert 16*a* and the side insert 16*b* (FIGS. 3A, 3B), the handle 12 is readily positioned for either front or side tank mounting of the handle 12 respectively (compare FIGS. 2A and 2B to FIG. 2C). That is, the insert 16*a*, 16*b* positions the handle 12 within the tank lever escutcheon 22 for proper actuation depending upon whether the toilet tank lever assembly 10 is side or front mounted.

The tank lever escutcheon 22, the tank lever mounting gasket 24, the mounting washer 26, and the mounting nut 28 permit the assembly 10 to be mounted through an aperture in a toilet tank (FIGS. 2A-2D). The tank lever escutcheon 22 includes a threaded section 22*t* which receives the mounting nut 28. Notably, the tank lever escutcheon 22 is of a common design such that various tank lever rosettes 20 (three shown) may be supported thereby. That is, the tank lever escutcheon 22 is a structural component which may be utilized to support a multitude of various aesthetic tank lever rosettes 20 to provide various aesthetic appearances.

Figure 4A:
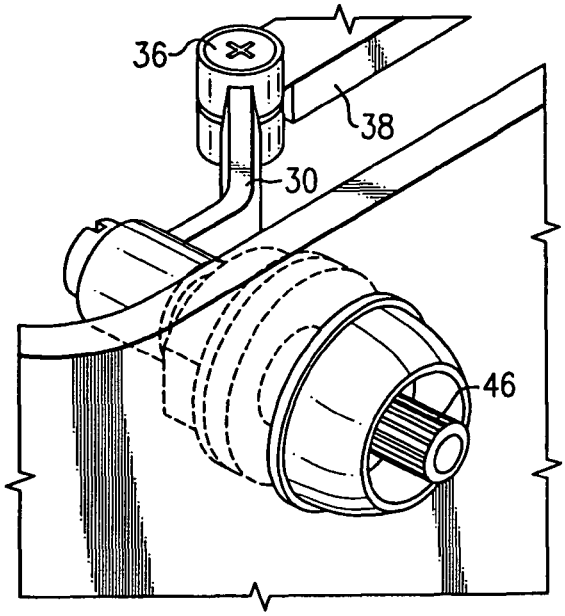
FIG. 4A is an expanded assembly view illustrating a spline lever post for receipt of a handle assembly.
Figure 4B:
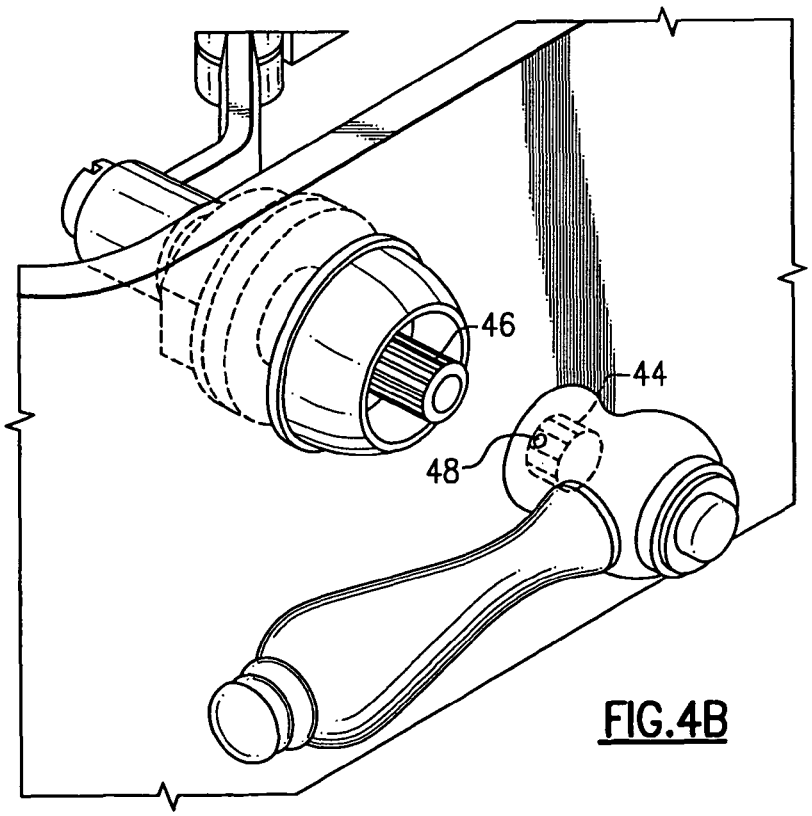
FIG. 4B is the spline lever post of FIG. 4A with one associated handle assembly.
Figure 4C:
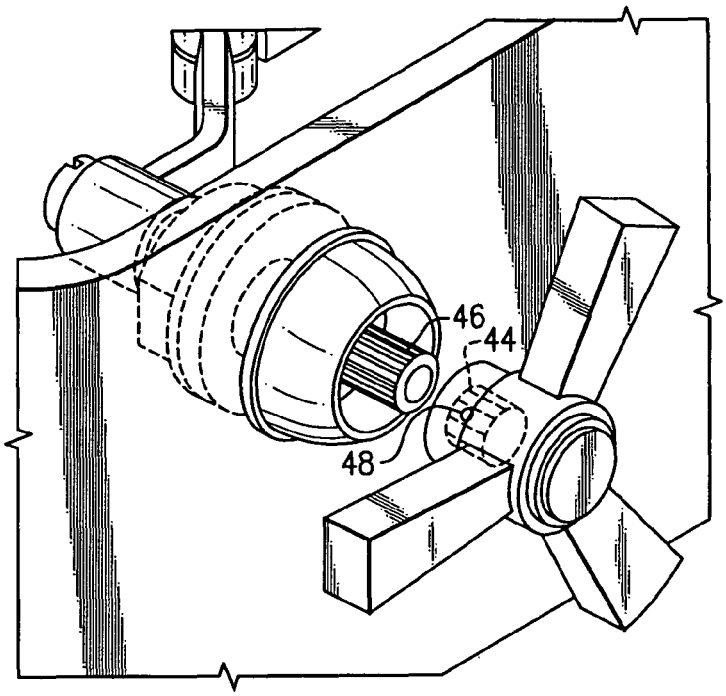
FIG. 4C is another spline lever post of FIG. 4A with one associated handle assembly.

Various handles 12 (various examples shown) may also be readily attached to the lever post 14 to provide various aesthetic appearances. The handles 12 preferably include an attachment arrangement with a splined inner surface 44 (FIGS. 4A-4C) which engages a corresponding splined segment 46 on the lever post 14. The handle 12 is preferably retained with a set screw 48 or the like. The splined engagement surface of the handle 12 permits the handle 12 to be azimuthally positioned relative the lever post 14 to provide still further adjustment. The type of splined engagement surface also preferably correspond to what is a common attachment spline of faucet handles such that the toilet tank handle may be matched to a faucet assembly within the bathroom. Such an attachment arrangement allows a toilet handle to be coordinated to the faucet handle to provide a desirable aesthetic match. Alternatively, the handle may be integrated with the post as illustrated by the three lower versions in FIG. 1.

Figure 5:
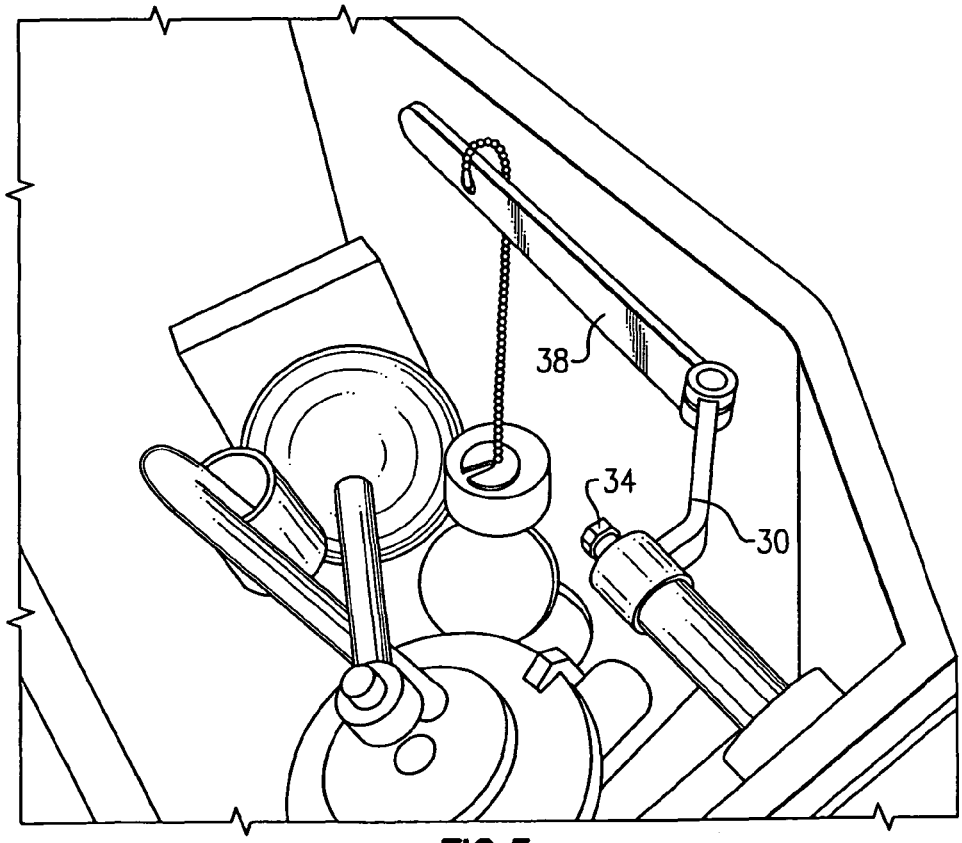
FIG. 5 is a top perspective view illustrating the toilet tank lever assembly mounted within a toilet tank.
Figures 6A, 6B:
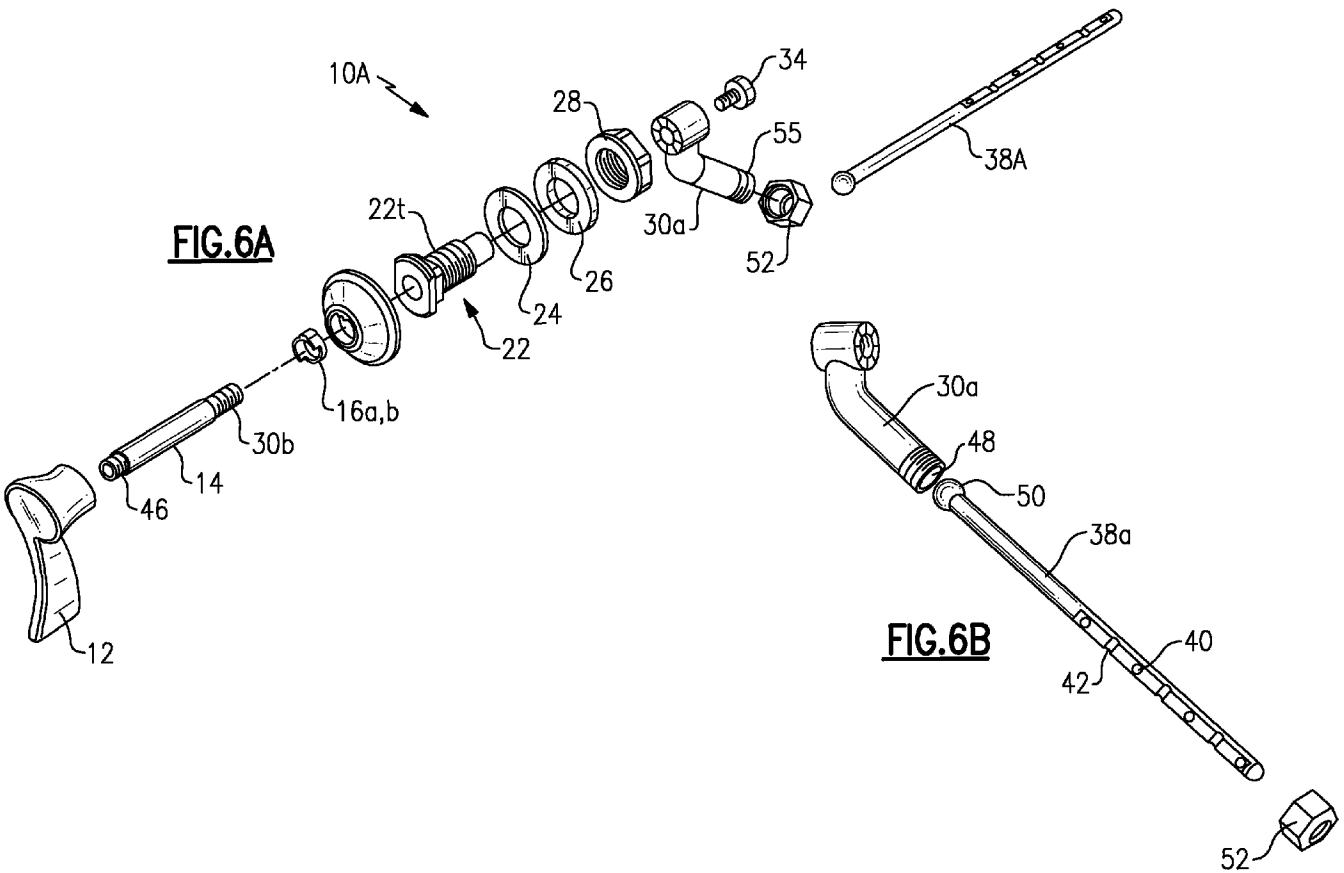
FIG. 6A is an exploded view of another toilet tank lever assembly.
FIG. 6B is an exploded view of a ball and socket interface between a short lever arm and a long lever arm of the toilet tank lever assembly.

Reversing of the short lever arm 30 (compare FIGS. 2A and 2B) essentially doubles the number of mounting possibilities. Notably, because the belleville spring 32 and fastener screw 34 are located along the axis A, the short lever arm 30 may be readily reversed while still providing access to the fastener screw 34 when the toilet tank lever assembly 10 is mounted within the tank (FIG. 5). Notably, fastener 34 preferably includes a knurled surface 34*s* such that it may be installed/removed without tools Referring to FIG. 6A, another toilet tank lever assembly 10A includes another short lever arm 30A and long lever arm 38A interface. The toilet tank lever assembly 10A otherwise includes generally comparable components to those described above with regards to the toilet tank lever assembly 10.

Figure 6D:
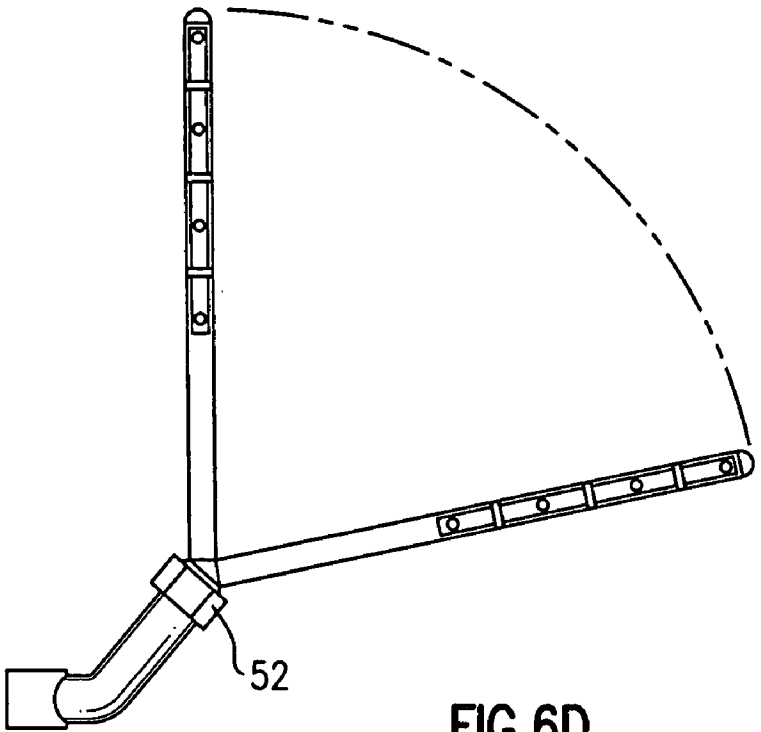
FIG. 6D is a view of the toilet tank lever assembly of FIG. 6A in a front mount installation arrangement illustrating the envelope provided by the lever assembly interface.
Figure 6C:
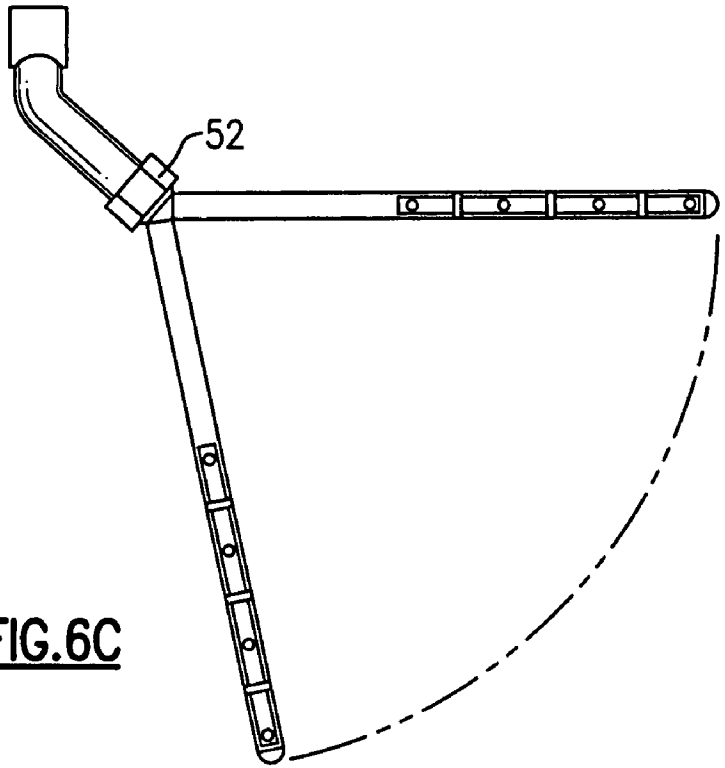
FIG. 6C is a view of the toilet tank lever assembly of FIG. 6A in a side mount installation arrangement illustrating the envelope provided by the lever assembly interface.

The short lever arm 30A includes a semi-spherical socket 48, and the long lever arm 38A includes a semi-spherical ball 50. A threaded nut 52 is engageable with corresponding threads 55 on the short lever arm 30A adjacent the semi-spherical socket 48 (best seen in FIG. 6B). The long lever arm 38A may thereby be mounted at various angles relative to the short lever arm 30A such that various toilet tanks may be thereby accommodated. Notably, the ball and socket interface permits adjustment within a conical envelope (FIGS. 6C-6D). Essentially, an infinite degree of adjustment is provided by the ball and socket interface within the conical adjustment envelope.

Referring to FIGS. 6A-6D, the semi-spherical ball 50 is received within the semi-spherical socket 48 to position the long lever arm 38A relative the short lever arm 30A. The long lever arm 38A is readily positioned relative the short lever arm 30A simply by loosening the threaded nut 52, positioning long lever arm 38A then again securing the threaded nut 52. Such an arrangement facilitates various side mount installations as well as various front mount installations with a relatively uncomplicated lever assembly 10A.

Furthermore, it should be noted that the short lever arm 30 may be reversed as described and may be mounted at various azimuthal positions relative the lever post 14 as described above to still further increase the number of mounting possibilities.

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A toilet tank lever assembly comprising:

a lever post which defines an axis of rotation, said lever post includes a splined interface for receipt of a handle with a corresponding splined interface;

a long lever arm;

a reversible short lever arm adjustably mountable through a toothed interface to said long lever arm to define an angle therebetween and position said long lever arm within the toilet tank, said reversible short lever arm having a splined interface to mount said reversible short lever arm in one of two orientations along said axis; and a fastener along said axis of rotation which mounts said reversible short lever arm to said lever post.

2. The toilet tank lever assembly as recited in claim 1, further comprising an insert engageable with said lever post to position said lever post for one of a side or front toilet tank mounting location.

3. The toilet tank lever assembly as recited in claim 1, wherein said reversible short lever arm and said long lever arm are angularly adjustable at said toothed interface to facilitate the positioning of the lever assembly within the toilet tank, said long lever arm having at least one aperture.

4. The toilet tank lever assembly as recited in claim 3, further comprising a fastener which maintains angular engagement of said toothed interface of said reversible short lever arm and said long lever arm.

5. The toilet tank lever assembly as recited in claim 1, wherein said lever post includes a splined interface and said reversible short lever arm includes a corresponding splined interface, said splined interface of said lever post operable to receive said corresponding splined interface of said reversible short lever arm such that said reversible short lever arm is azimuthally positionable relative said lever post.

6. A toilet tank lever assembly comprising:

a lever post which defines an axis of rotation, said lever post including a splined segment;

a handle having a splined aperture to receive said splined segment;

a long lever arm;

a fastener along said axis of rotation which mounts said reversible short lever arm to said lever post;

a reversible short lever arm adjustably mountable through a toothed interface to said long lever arm to define an angle therebetween and position said long lever arm within the toilet tank, said reversible short lever arm having a splined interface to mount said reversible short lever arm in one of two orientations along said axis; and an angularly adjustable interface between said reversible short lever arm and said long lever arm, said angularly adjustable interface securable against adjustment to restrain said long lever arm relative said reversible short lever arm.

7. The toilet tank lever assembly as recited in claim 6, wherein said long lever arm includes at least one aperture and at least one cut-off groove.

8. A toilet tank lever assembly comprising:

a lever post which defines an axis of rotation, said lever post including a splined segment;

a handle having a splined aperture to receive said splined segment;

a tank lever escutcheon which receives said lever post therethrough;

a long lever arm;

a fastener along said axis of rotation which mounts said reversible short lever arm to said lever post;

a reversible short lever arm adjustably mountable through a toothed interface to said long lever arm to define an angle therebetween and position said long lever arm within the toilet tank, said reversible short lever arm having a splined interface to mount said reversible short lever arm in one of two orientations along said axis; and an interchangeable insert engageable with said lever post to selectively position said handle for one of a side or front toilet tank mounting location, said insert selected according to the desired mounting location of said handle on the toilet tank.

9. The toilet tank lever assembly as recited in claim 8, further comprising:

said long lever arm having at least one aperture;

said reversible short lever arm mountable to said long lever arm to define an angle therebetween; and a fastener along said axis of rotation which mounts said reversible short lever arm to said lever post in one of two orientations along said axis.

10. The toilet tank lever assembly as recited in claim 8, further comprising:

a fastener along said axis of rotation which mounts said reversible short lever arm to said lever post;

a ball and socket interface between said reversible short lever arm and said long lever arm; and a fastener mountable to one of said long lever arm or reversible short lever arm to at least partially engage said ball and socket interface to restrain said long lever arm relative said reversible short lever arm.

11. The toilet tank lever assembly as recited in claim 9, wherein said fastener includes a threaded nut which is passed over said long lever arm to threadably engage corresponding threads on said reversible short lever arm.

12. The toilet tank lever assembly as recited in claim 9 wherein said reversible short lever arm and said long lever arm have a toothed interface therebetween for adjustable connection to define said angle therebetween to position said long lever arm within the toilet tank.

13. The toilet tank lever assembly as recited in claim 6 wherein said angularly adjustable interface is a toothed interface for adjustable connection of said long lever arm relative to said reversible short lever arm.

14. The toilet tank lever assembly as recited in claim 13, further comprising a fastener which maintains angular engagement of said toothed interface of said reversible short lever arm and said long lever arm.

15. The toilet tank lever assembly as recited in claim 1 wherein said angularly adjustable interface is defined about an axis transverse to said axis of rotation.

16. The toilet tank lever assembly as recited in claim 6 wherein said angularly adjustable interface is defined about an axis transverse to said axis of rotation.

17. The toilet tank lever assembly as recited in claim 6 wherein said angularly adjustable interface is a ball and socket interface between said reversible short lever arm and said long lever arm, a fastener mountable to one of said long lever arm or reversible short lever arm to at least partially engage said ball and socket interface to restrain said interface.

18. The toilet tank lever assembly as recited in claim 17 wherein said ball and socket interface includes a semi-spherical socket in said reversible short lever arm and a semi-spherical ball at a distal end of said long lever arm.

* * * * *